US005741338A

United States Patent [19]

Singleton

[11] Patent Number: 5,741,338

[45] Date of Patent: Apr. 21, 1998

[54] BIODEGRADABLE DYE LEVELER COMPOUNDS FOR ACRYLIC FIBERS

[75] Inventor: Terry E. Singleton, Jamestown, N.C.

[73] Assignee: High Point Chemical Corporation, High Point, N.C.

[21] Appl. No.: 813,250

[22] Filed: Mar. 7, 1997

[51] Int. Cl.[6] ..... D06P 3/76; D06P 1/41

[52] U.S. Cl. ..... 8/606; 8/654; 8/927

[58] Field of Search ..... 8/606, 654–657, 8/927

[56] References Cited

U.S. PATENT DOCUMENTS 2,963,339 12/1960 Keller ..... 8/606

3,666,403 5/1972 Shimauchi et al. ..... 8/606

3,869,250 3/1975 Wegmuller et al. ..... 8/606

4,181,499 1/1980 Koller et al. ..... 8/606

*Primary Examiner*—Margaret Einsmann

*Attorney, Agent, or Firm*—Bruce F. Jacobs

[57] ABSTRACT

Biodegradable quaternaries of amidoamines are disclosed for use as dye leveler compounds in the basic dyeing of acrylic and other fibers. The quaternary compounds of the invention have leveling activity equivalent to benzyl trimethyl ammonium chloride, but with much higher biodegradability, and generate low foam.

23 Claims, No Drawings

BIODEGRADABLE DYE LEVELER COMPOUNDS FOR ACRYLIC FIBERS

BACKGROUND OF THE INVENTION

This invention relates to the dyeing of synthetic fibers which have been modified chemically to make them receptive to basic, i.e. cationic, dyestuffs, especially acrylic fibers. More particularly, this invention relates to the use of dye levelers, chemical additives, in a dye bath to cause uptake of a dye onto a fiber to be more uniform during the dye exhaustion process so that later migration of a dye is less necessary to achieve uniform dyeing. The dyeing industry frequently interchanges usage of the words "leveler" and "migrator" and they are used in this manner herein.

Synthetic fibers have such a strong affinity for basic dye-stuffs that the dyes which become absorbed on dye sites on the fibers do not distribute themselves uniformly under atmospheric dyeing conditions at the boil. This results in uneven or unlevel dyeing. In the dyeing of acrylic fibers in particular, the affinity of a dye and the rate of exhaustion of the dye from the dye bath vary with the dye being used often making the levelness of dyeing unpredictable. Temperature differences from one part of the dyeing equipment to the other aggravate this difficulty. To increase the absorption and improve the levelness (evenness) of the dyeings, certain substances generally referred to as dye levelers are conventionally added to the dye bath to promote/control dyeing. The manner in which the dyeing is accomplished depends generally upon the particular dyestuff used. Usually, a dye leveler will aid in promoting level deposition of the dye on the fiber or fabric in several ways. Some dye levelers accomplish the desired result by modifying the absorption of the dye by the fiber. Other dye levelers function by retarding the rate of strike at the dyeing temperature.

Although many methods for obtaining level cationic dyeings of acrylic fibers are described in the literature, c.f. U.S. Pat. Nos. 3,667,899, 3,632,300, 3,355,243, and 4,074,970, the industry standard dye leveler heretofore has been benzyl trimethyl ammonium chloride (BTMAC). However, BTMAC has been recently classified by the U.S. Department of Transportation as a Class 6.1 poison requiring the use of precautionary labeling. Class 6.1 poison designation requires labeling of drums and placarding of bulk shipments; shipping papers must reflect hazard information; drums must meet specifications; and employees handling material must receive specialized training. Shipping and storage concerns have made it desirable to find a safer alternative leveler/migrator. Furthermore, BTMAC has a very low degree of biodegradability, i.e. it persists in the environment for a long time. In view of the environmental concerns, such a compound is no longer commercially desirable and the present invention arose from a desire to develop an alternative dye leveler which is (i) functionally equivalent to BTMAC in dye leveling performance, (ii) functionally equivalent to BTMAC in generating minimal amounts of foam, and (iii) more acceptable from an environmental point of view.

U.S. Pat. No. 4,074,970 discloses one alternative to BTMAC, the benzyl chloride quaternary of triethyl amine (BTEAC). However, the biodegradability of BTEAC has been found to be only marginally better than BTMAC based upon testing done against Environmental Protection Agency-certified seed.

Before BTMAC became the industry standard, numerous other cationic compounds were suggested for use in obtaining level cationic dyeings of acrylic fibers. For example, U.S. Pat. No. 2,963,339 discloses quaternized amidoamines of the formula:

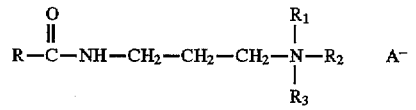

wherein R is an acyl group derived from an aliphatic carboxylic acid containing 12 to 22 carbon atoms, i.e. R has 11 to 21 carbon atoms; $R_1$ and $R_2$ are each an aliphatic hydrocarbon radical with 1 to 6 carbon atoms; and $R_3$ is a lower alkyl group or a lower aralkyl group; and $A^{3I}$ is a monovalent anion. Although the compounds are effective as dye levelers and environmentally more acceptable than BTMAC, their use results in the generation of an excessive amount of foam. The quaternized amidoamine dye levelers of the present invention unexpectedly do not generate large amounts of foam in use.

U.S. Pat. No. 3,869,250 (Wegmuller et al) discloses a dyeing process for acrylonitrile that includes a pre-treatment to the actual dyeing step which pre-treatment uses numerous cationic compounds including, inter alia, quaternized amidoamines of the above formula wherein R is an alkyl radical containing 8 to 18 carbon atoms. In the Wegmuller process, an acrylic fabric is pre-treated with a cationic compound, washed thoroughly with warm and then cold water, and dried. Then the dried fabric is placed into a dyebath with non-pre-treated fabric and dyed in the absence of any cationic pre-treating compound. Moreover, the only specific such compounds disclosed in Wegmuller et al are those in which R is $C_{11}$ (Example 17), $C_{17}$ (Example 19), or where the compounds are prepared from coconut oil fatty acid chloride (col. 3, 1.49–55). Coconut oil fatty acid is a mixture of eight acids: 7.8–9.5% $C_8$ alkyl, 4.5–9.7% $C_{10}$ alkyl, 44–51% $C_{12}$ alkyl, 13–18.5% $C_{14}$ alkyl, 7.5–10.5% $C_{16}$, 1–3% $C_{18}$, 5–8.2% monounsaturated $C_{18}$, and 1.0–2.6% diunsaturated $C_{18}$. It has now been discovered that quaternized amidoamines having only 7 to 9 carbon atoms in the R alkyl radical exhibit unexpectedly lower foaming as compared to those homologues which have 11 to 21 carbon atoms.

U.S. Pat. No. 4,181,499 (Koller et al) discloses a dyeing process for acrylonitrile that optionally makes use of numerous cationic dye retarders which include, inter alia, quaternized amidoamines of the above formula wherein R is an alkyl radical having 7 to 17 carbon atoms. Preferred Koller retarders are those having cation weights of less than 310—which excludes all quaternized amidoamines wherein $R_4$ is an aralkyl group. The Koller retarders are used in amounts too low to accomplish substantial dye leveling. It has now been discovered that there is a substantial and unexpected difference in the amount of foam generated between quaternized amidoamines wherein R contains 7 to 9 carbon atoms vs. those containing 11 to 21 carbon atoms. The compounds containing 11 to 21 carbon atoms have not been found suitable for commercial use because they create an excessive amount of foam.

Accordingly, there is a need for dye levelers for acrylic fibers which are at least as effective as BTMAC in performance while (i) exhibiting substantially higher biodegradability and (ii) not generating excessively high levels of foam. It is an object of the present invention to provide such dye levelers.

This and other objects of the present invention will become apparent as the description thereof proceeds.

DETAILED DESCRIPTION OF THE INVENTION

It has been discovered that the disadvantages of the prior art may be overcome by the use of the leveler compounds of the present invention in combination with a conventional basic dyeing process for acrylic fibers. The leveler compounds of the present invention are quaternaries of amidoamine compounds which have the following general formula:

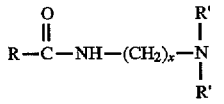

wherein R is a straight chain or branched alkyl group containing 7 to 9 carbon atoms; each R' is an alkyl group having 1 to 3 carbon atoms; and x is an integer from 2 to about 4. Preferably R is a straight chain or branched alkyl group containing 7 to 8 carbon atoms. Most preferably R is a straight chain alkyl group containing 7 to 8 carbon atoms. Also most preferably each R' is methyl and x is 3.

Any conventional quaternizing agent may be used to produce the final leveler compound. Examples of suitable quaternizing agents include benzyl halides such as benzyl chloride and substituted benzyl chlorides; di(lower alkyl) sulfates such as dimethyl sulfate, diethyl sulfate, dipropyl sulfate, diisopropyl sulfate, dibutyl sulfate, and diisobutyl sulfate; alkali metal monohaloacetates such as sodium monochloroacetate; and Michael reaction acceptors such as acrylic acid, methacrylic acid, and esters thereof.

Most preferably the amidoamine quaternary compounds useful in the present invention have the following formula:

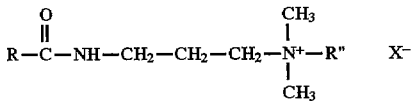

wherein R is as defined above, and R" is derived from the quaternizing agent and is preferably selected from the group consisting of benzyl, methyl, ethyl, propyl, butyl, propionate or betaine moiety, and X is an anion.

Typical quaternized amidoamine compounds useful herein include: the reaction product of pelargonic acid, dimethylamino-propylamine, and benzyl chloride (Chem. Abst. name: benzenemethan-aminium-N,N-dimethyl-N-[3-[(1-oxononyl)amino]propyl]-chloride; and the caprylic acid, isononanoic acid, and capric acid reaction product analogs thereof; the reaction product of pelargonic acid, dimethylaminopropylamine, and diethyl sulfate and the caprylic acid, isononanoic acid, and capric acid reaction product analogs thereof; the reaction product of pelargonic acid, dimethylaminopropylamine, and dimethyl sulfate, and the caprylic acid, isononanoic acid, and capric acid reaction product analogs thereof.

The quaternized leveler compounds are generally prepared in a two-step reaction sequence. First an amidoamine intermediate is formed by reacting a carboxylic acid of the formula R-COOH, wherein R is as defined above, with dimethylaminoalkylamine, preferably dimethylaminopropylamine, and second the amidoamine compound is quaternized in a quaternization reaction. As these reactions are each conventional organic chemical reactions further details are not provided herein as they may be readily found in the chemical literature.

To obtain suitable dye leveling performance, the quaternized amidoamines are used in amounts of greater than 1% based on the weight of the fabric (owf) in the dyebath. Preferably the quaternized amidoamines are used in amounts of about 1.5 to 5% owf. These amounts of quaternized amidoamines result in a substantially reduced level of foam during the dyeing process.

Acrylic fibers are any manufactured fibers in which the fiber-forming substance is any long-chain polymer comprised of at least 85% by weight of acrylonitrile units. Various comonomers such as sulfonated styrene and methacrylic acid are commonly incorporated into the polymer chain to provide anionic dye sites and to lower the degree of crystallinity and hence the glass transition temperature. Polymerization catalysts such as potassium persulfate are also commonly used to endcap the polymer chain with anionic sulfonate groups. Suitable such fibers are commercially available from several sources including under the following tradenames: Acrilan (Monsanto) and Creslan (Cytec Industries).

Acrylic fibers are generally dyed with basic (or cationic) dyes although disperse dyes are sometimes used to obtain light shades. Below the glass transition temperature (Tg) of the acrylic fiber (about 70°–90° C.), the rate of dyeing is extremely low. Above this temperature the rate of dyeing becomes extremely fast such that an increase of only several degrees in temperature can double the rate of dyeing. This phenomenon makes the level dyeing of acrylic fibers particularly difficult and the use of dye levelers has been required. The dyeing of acrylic fiber is generally done at a temperature below about 110° C. to avoid fiber damage.

Suitable basic (or cationic) dyes for use herein generally possess a characteristic quaternary nitrogen center in addition to a specific chromophore region. Thus, the key dye molecule/dye site interaction is ionic (cationic site of dye molecule and anionic site in polymer chain). Additional information regarding suitable basic dyes is readily available in the literature and thus such is not included herein.

Dye bath testing has demonstrated that the compound of Example I (50% active) can consistently be used pound for pound in place of the current preferred commercial migrator/leveler (BTMAC) (60% active). In many cases, it has been found that the compound of Example I can be used at 67% of the level of BTMAC (i.e. 2% owf (on the weight of the fabric) vs. 3% owf.)

Foam testing in a JFO jet-dye machine has indicated that the compound of Example I generated only a slightly higher level of foam (1.57 cm vs. 1.41 cm) than that generated by BTMAC. These levels are substantially equivalent.

Foam testing in a JFO jet-dye machine has indicated that the compounds of the present invention wherein R is an alkyl group having 7 to 9 carbon atoms exhibit substantially lower foam than similar compounds wherein the R group is an alkyl group containing 11 to 21 carbon atoms. Thus the compounds of the present invention are useful in the absence of additional defoaming agents. The use of the claimed compounds results in a substantially reduced level of foam during the dyeing process.

In the following non-limiting examples, all parts and percents are by weight unless otherwise specified.

EXAMPLE I

Preparation of Dye Leveler Compound

To form an amidoamine intermediate from pelargonic acid and dimethylaminopropylamine (DMAPA), pelargonic acid (also called nonanoic acid) (66.6 parts) was charged to a reactor, degassed, and heated to 160° C. A slight stoichiometric excess of DMAPA (47.3 parts) was added slowly and the mixture heated to 180° C. where it was held until the acid value was determined to be less than 5.0. The amidoamine intermediate was then steam-stripped to remove residual DMAPA, diluted with water, and cooled to about 40° C., prior to quaternization with slightly less than one molar equivalent of benzyl chloride. The final solids were about 50%.

EXAMPLE II

The above basic procedure was repeated to produce additional quaternized amidoamines from the following starting materials. In each case the R group contains one less carbon atom than indicated for the acid.

| Acid | Bisamine | Quaternizing Agent |
|---|---|---|
| Caprylic (C8) | DMAPA | Benzyl chloride |
| 2-Ethylhexanoic (C8) | " | " |
| 3,5,5-Trimethylhexanoic (C9) | " | " |
| 2-Methyloctanoic (C9) | | |
| Pelargonic (C9) | " | " |
| Pelargonic* (C7–10) | " | " |
| Capric (C10) | " | " |
| Coconut oil (mixed C12/C14) | " | " |
| Lauric (C12) | " | " |
| Myristic (C14) | " | " |
| Caprylic (C8) | " | Dimethyl sulfate |
| 2-Ethylhexanoic (C8) | " | " |
| Pelargonic (C9) | " | " |
| Capric (C10) | " | " |
| Lauric (C12) | " | " |

*Mixed acid, primarily pelargonic (C9)

EXAMPLE III

The dye leveler of Example I and several of those from Example II were evaluated for performance in standard acrylic dyeing procedures, c.f. The Dyeing of Textile Fibers, Theory and Practice, Joseph Rivlin, Dept. Of Chemistry & Physical Science, Philadelphia College of Textiles & Science (1992), page 181. The tests, including migration, retardation, strike rate, and yield, were made using an Ahiba Polymat automatic dyeing machine. The dye baths had a 10:1 liquor to fabric ratio and contained sodium sulfate (aka Glauber's salt, 5% on the weight of the fabric (owf)), acetic acid (1% owf), and the basic dye (1% owf). For the migration, retardation, strike rate and yield testing, the basic dyes evaluated were green, navy, teal, pink, lavender, winterberry, and beige.

Table I contains a summary of performance data for some preferred levelers/migrators of the present invention in comparison with the current industry standard leveler/migrator benzyltrimethylammonium chloride (BTMAC). The levelers of this invention reported in Table I are: (i) benzyl chloride quaternary of pelargonic acid-DMAPA; (ii) benzyl chloride quaternary of capric acid-DMAPA; (iii) diethylsulfate quaternary of capric acid-DMAPA; and (iv) diethylsulfate quaternary of pelargonic acid-DMAPA. In addition, a commercial acrylic dye retarder, octyl dimethylamine benzyl chloride quaternary (ODMA-BC), was added along with the compound of Example I. The data is reported segregated into migration, retardation, strike rate, and yield categories. Also provided is the 14 day per cent BOD results for the various compounds. The performance of the compounds of the present invention were evaluated on a gray-scale rating therefrom with a range from 1.00 (poorest) to 5.00 (best performance). The ratings for each performance category represent the numerical average based upon all of the colors tested. For ease of comparison, the performance of BTMAC was always rated 3.00.

TABLE I

| DYE LEVELER and % OWF | Migration | *Retardation | Strike Rate | Yield | BOD-14(%) |
|---|---|---|---|---|---|
| BTMAC (Comparison) (2%) | 3.00 | 3.00 | 3.00 | 3.00 | 3 |
| Capric-BC (2%) | 3.00 | 3.38 | 3.13 | 3.38 | 56 |

TABLE I-continued

| DYE LEVELER and % OWF | Migration | *Retardation | Strike Rate | Yield | BOD-14(%) |
|---|---|---|---|---|---|
| Capric-DES (2%) | 2.25 | 3.63 | 3.13 | 3.75 | 100 |
| Pelargonic-DES (2%) | 2.38 | 3.50 | 3.00 | 3.88 | 96 |
| Pelargonic-BC (4%) | 3.63 | 3.00 | 3.13 | 2.88 | 63 |
| Pelargonic-BC (2%) | 3.13 | 3.13 | 3.13 | 3.50 | 63 |
| Pelargonic-BC (2%)/ODMA-BC retarder (2%) Blend | 3.00 | 3.00 | 2.88 | 2.75 | 80 |

*Higher retardation rating means less retardation

EXAMPLE IV

Biodegradability Testing

Differentiation between the quaternary compunds of the present invention and both BTMAC and the benzyl chloride quaternary of triethylamine (BTEAC) (Tanassist ESL-CONC from Sybron Chemical Corp.), a proposed replacement for BTMAC, can be made based upon the differences in biodegradability testing performed on EPA certified seed. Table II below provides the percent biodegradability of the compounds after various time periods over a 60 day cycle. The dye leveler compounds of the present invention evaluated were: (1) the benzyl chloride quaternary of pelargonic acid/DMAPA (Example I); (2) the benzyl chloride quaternary of capric acid/DMAPA); (3) the diethylsulfate quaternary of pelargonic acid/DMAPA; (4) the diethylsulfate quaternary of capric acid/DMAPA. The data indicates that the dye leveler compounds of the present invention are superior to both BTMAC and BTEAC.

TABLE II

| | % BIODEGRADED WITHIN STATED TIME PERIODS | | | |
|---|---|---|---|---|
| | 5 days | 14 days | 28 days | 60 days |
| BTEAC | 6 | 8 | 10 | 14 |
| BTMAC | 2 | 3 | 4 | 12 |
| Pelargonic-BC | 32 | 63 | 72 | 91 |
| Capric-BC | 34 | 56 | 67 | 75 |
| Pelargonic-DES | 44 | 96 | 100 | 100 |
| Capric-DES | 38 | 100 | 100 | 100 |

Toxicity testing on *Ceriodaphnia dubia* indicated that all of the cationic migrators tested showed similar adverse toxicity effects typical of their generic class. However, the chronic and persistent effects can be minimized by the greatly accelerated biodegradability of the compounds of this invention.

EXAMPLE V

To determine the usefulness of the quaternized amidoamines in actual dyeing operations, various such compounds were evaluated for generation of foam in a JFO Jet Dye Machine. Table III below provides the results obtained in which the amount of foam is reported in centimeters as a function of the number of carbon atoms in the R alkyl group. The test was begun at a bath temperature of 120° F. and increased in 10° F. increments until reaching 225° F., whereupon the bath was maintained for 15 minutes. The maximum foam measurable was 30 cm.

TABLE III

FOAM TESTING RESULTS

| Temperature | | Carbon Atoms in "R" | | | | | | | | | |
|---|---|---|---|---|---|---|---|---|---|---|---|
| °F. | °C. | 7 | 8 | 8* | 9 | 11 | 13 | 15 | 17 | 17** | 19/21 |
| 120 | 49 | 1.7 | 4.4 | 3.7 | 12.0 | >30 | >30 | >30 | >30 | >30 | 20.0 |
| 130 | 54 | 1.3 | 3.7 | 3.3 | 7.8 | >30 | >30 | >30 | >30 | >30 | 20.5 |
| 140 | 60 | 1.2 | 3.0 | 2.6 | 5.3 | >30 | >30 | >30 | >30 | >30 | >30 |
| 150 | 66 | 0.9 | 2.0 | 2.4 | 3.3 | >30 | 29.0 | >30 | >30 | >30 | >30 |
| 160 | 71 | 0.7 | 1.7 | 2.0 | 2.3 | >30 | 28.0 | >30 | >30 | >30 | >30 |
| 170 | 77 | 0.7 | 1.2 | 1.9 | 2.0 | >30 | 29.0 | >30 | >30 | >30 | >30 |
| 180 | 82 | 0.7 | 1.0 | 1.8 | 1.8 | >30 | 29.5 | >30 | >30 | >30 | >30 |
| 190 | 88 | 0.7 | 1.0 | 1.7 | 1.7 | >30 | >30 | >30 | >30 | 28.0 | >30 |
| 200 | 93 | 0.8 | 1.0 | 1.8 | 1.6 | >30 | >30 | 29.0 | 29.0 | 27.5 | >30 |
| 210 | 99 | 0.7 | 1.0 | 1.8 | 1.5 | 17.0 | 29.0 | 29.0 | 30.0 | 28.0 | >30 |
| 220 | 105 | 0.8 | 1.0 | 1.8 | 1.5 | 13.0 | 29.0 | >30 | 30.0 | 28.0 | >30 |
| 225 | 107 | 0.8 | 1.0 | 1.7 | 1.5 | 11.8 | 28.0 | >30 | >30 | 28.0 | >30 |
| 225 | 15 min | 1.2 | 1.2 | 2.3 | 1.7 | 10.5 | 30.0 | >30 | >30 | 30.0 | >30 |
| AVER. | FOAM | 0.94 | 1.78 | 2.22 | 3.38 | NA | NA | NA | NA | NA | NA |

*2-methylheptyl, i.e. derived from 2-methyloctanoic acid
**heptadecenyl, i.e. derived from oleic acid As the data indicates, those compounds wherein the number of carbon atoms in the R group is 11 or higher generate excessive amounts of foam and only those compounds which have 7 to 9 carbon atoms in the R group generate sufficiently low levels of foam to be useful and that those compounds which have 7 or 8 carbon atoms in the R group are the best. Compounds which generate foam amounts below 5 cm at all of the temperatures tested are preferred. As such, the compounds wherein R is a straight chain or branched alkyl with 7 or 8 carbon atoms are preferred.

While certain specific embodiments of the invention have been described, it will be understood that this is solely to illustrate the invention to persons skilled in the art. It will be recognized that various changes and modifications may be made without departing from the spirit of the invention or the scope of the appended claims.

What is claimed is:

1. A process of coloring cationic-dyeable fibers in the presence of an amidoamine compound which has been quaternized, wherein prior to quaternization the amidoamine compound has the following formula:

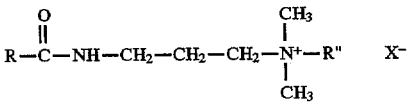

wherein R is a straight chain or branched alkyl group containing 7 to 9 carbon atoms; each R' is an alkyl group having 1 to 3 carbon atoms; and x is an integer from 2 to about 4.

2. The process of claim 1 wherein the cationic-dyeable fiber is an acrylic fiber.

3. The process of claim 2, wherein R is a straight chain alkyl group containing 7 to 8 carbon atoms.

4. The process of claim 2, wherein R is a branched alkyl group containing 8 carbon atoms.

5. The process of claim 2, wherein each R' is methyl and x is 3.

6. The process of claim 1, wherein after quaternization the quaternized amidoamine compound has the formula:

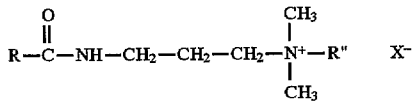

wherein R" is selected from the group consisting of benzyl, methyl, ethyl, propyl, butyl, propionate, and betaine moiety, and X is an anion.

7. The process of claim 6, wherein the anion is selected from the group consisting of halide and (lower alkyl)sulfate wherein the lower alkyl group contains 1 to 6 carbon atoms.

8. A coloring bath containing a fabric to be dyed, a cationic dyestuff, and an amidoamine compound which has been quaternized, said amidoamine compound prior to quaternization being of the formula:

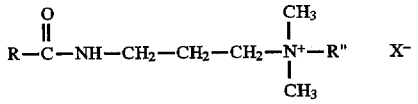

wherein R is a straight chain or branched alkyl group containing 7 to 9 carbon atoms; each R' is an alkyl group having 1 to 3 carbon atoms; and x is an integer from 2 to about 4.

9. The bath of claim 8, wherein R is a straight chain alkyl group containing 7 to 8 carbon atoms.

10. The bath of claim 2, wherein R is a branched alkyl group containing 8 carbon atoms.

11. The bath of claim 8, wherein each R' is methyl and x is 3.

12. The bath of claim 11, wherein after quaternization the quaternized amidoamine compound has the formula:

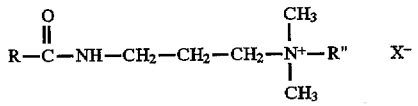

wherein R" is selected from the group consisting of benzyl, methyl, ethyl, propyl, butyl, propionate, and betaine moiety, and X is an anion.

13. The bath of claim 12, wherein the anion is selected from the group consisting of halide and (lower alkyl)sulfate wherein the lower alkyl group contains 1 to 6 carbon atoms.

14. The bath of claim 8, wherein after quaternization the quaternized amidoamine compound is present in an amount of about 1.5 to 5% on weight of the fabric.

15. The bath of claim 8, wherein the fabric is an acrylic fabric.

16. The bath of claim 8, in the absence of a defoaming agent.

17. A process of cationic dyeing of an acrylic fabric in the substantial absence of foam which comprises adding to the dyebath about 1.5 to 5% on weight of fabric in the dyebath an amidoamine compound which has been quaternized, wherein prior to quaternization the amidoamine compound has the following formula:

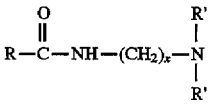

wherein R is a straight chain or branched alkyl group containing 7 to 9 carbon atoms; each R' is an alkyl group having 1 to 3 carbon atoms; and x is an integer from 2 to about 4.

18. The process of claim 17, wherein R is a straight chain alkyl group containing 7 to 8 carbon atoms.

19. The process of claim 17, wherein R is a branched alkyl group containing 8 carbon atoms.

20. The process of claim 17, wherein each R' is methyl and x is 3.

21. The process of claim 17, wherein after quaternization the quaternized amidoamine compound has the formula:

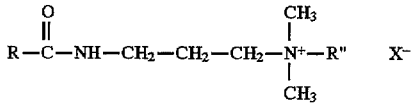

wherein R" is selected from the group consisting of benzyl, methyl, ethyl, propyl, butyl, propionate, and betaine moiety, and X is an anion.

22. The process of claim 21, wherein the anion is selected from the group consisting of halide and (lower alkyl)sulfate wherein the lower alkyl group contains 1 to 6 carbon atoms.

23. The process of claim 17, wherein the dyebath does not contain any defoaming agent.

* * * * *

UNITED STATES PATENT AND TRADEMARK OFFICE

CERTIFICATE OF CORRECTION

PATENT NO. : 5,741,338

DATED : April 21, 1998

INVENTOR(S) : Terry E. Singleton

It is certified that error appears in the above-identified patent and that said Letters Patent is hereby corrected as shown below:

On the cover page:

After Section 22: Insert the following

--Related U.S. Application Data

[60] Continuation-in-part of Ser. No. 613,338, March 11, 1996, abandoned. --

Claims 1 and 8: delete the formula and replace it with

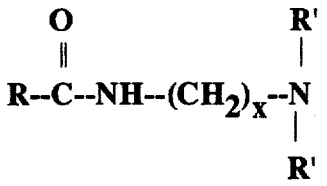

Signed and Sealed this

Thirtieth Day of June, 1998

*Attest:*

*Attesting Officer*

BRUCE LEHMAN

*Commissioner of Patents and Trademarks*